US009945205B2

(12) United States Patent
Hiorth

(10) Patent No.: US 9,945,205 B2
(45) Date of Patent: Apr. 17, 2018

(54) PLUGGING DEVICE

(71) Applicant: Interwell Technology AS, Ranheim (NO)

(72) Inventor: Espen Hiorth, Trondheim (NO)

(73) Assignee: Interwell Technology AS, Ranheim (NO)

( * ) Notice: Subject to any disclaimer, the term of this patent is extended or adjusted under 35 U.S.C. 154(b) by 569 days.

(21) Appl. No.: 14/417,343

(22) PCT Filed: Jul. 26, 2013

(86) PCT No.: PCT/EP2013/065800

§ 371 (c)(1),
(2) Date: Jan. 26, 2015

(87) PCT Pub. No.: WO2014/016408

PCT Pub. Date: Jan. 30, 2014

(65) Prior Publication Data

US 2015/0247374 A1 Sep. 3, 2015

(30) Foreign Application Priority Data

Jul. 26, 2012 (NO) ..... 20120851

(51) Int. Cl.
*E21B 33/128* (2006.01)
*E21B 33/12* (2006.01)

(52) U.S. Cl.
CPC ..... *E21B 33/128* (2013.01); *E21B 33/1208* (2013.01); *E21B 33/1216* (2013.01)

(58) Field of Classification Search
CPC ..... E21B 33/128; E21B 33/1208; E21B 33/1216; E21B 33/12; E21B 33/129; E21B 33/1293; E21B 33/1212; E21B 33/1295
See application file for complete search history.

(56) References Cited

U.S. PATENT DOCUMENTS 3,171,492 A 3/1965 Cochran
3,181,614 A * 5/1965 Brown ..... E21B 33/1295 166/122

(Continued)

FOREIGN PATENT DOCUMENTS

NO 332116 B1 6/2012

OTHER PUBLICATIONS

International Search Report issued in PCT/EP2013/065800 dated Jun. 23, 2014 (2 pages).

(Continued)

*Primary Examiner* — Wei Wang
(74) *Attorney, Agent, or Firm* — Osha Liang LLP

(57) ABSTRACT

A plugging device for sealing against an inner surface of a pipe includes a mandrel, a sealing device, and an actuating device. The sealing device includes a first body provided circumferentially around the mandrel, an upper supporting device provided axially above the first body, and a lower supporting device provided axially below the first body. The actuating device is connected to at least one of the supporting devices for actuating the sealing device between a retracted state and an expanded state. The sealing device includes a second, sealing body provided circumferentially around the mandrel. An inner surface of the second sealing body is engaged with an outer surface of the first body in the expanded state. The second sealing body is moved from the retracted state to the expanded state by an axial displacement of at least one of the supporting devices towards each other.

17 Claims, 4 Drawing Sheets

(56) References Cited

U.S. PATENT DOCUMENTS

Figure 3:
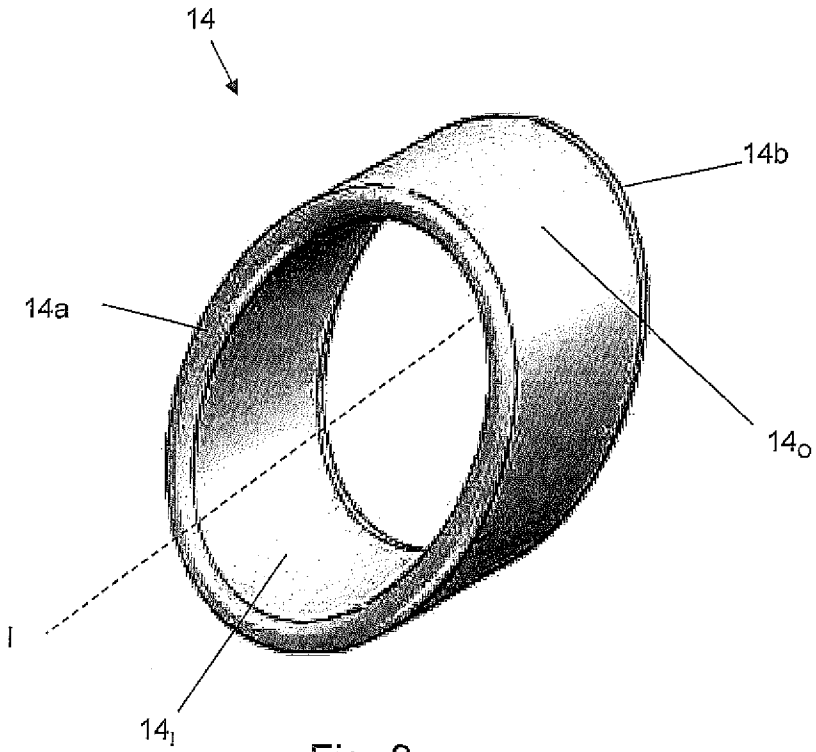

| | | | | |
|---|---|---|---|---|
| 6,318,461 | B1 | 11/2001 | Carisella | |
| 7,178,602 | B2 | 2/2007 | Hiorth et al. | |
| 2003/0079887 | A1* | 5/2003 | Lloyd | E21B 33/1212 166/387 |
| 2004/0069502 | A1 | 4/2004 | Luke | |
| 2004/0194969 | A1 | 10/2004 | Hiorth et al. | |
| 2006/0290066 | A1 | 12/2006 | Hiorth | |
| 2011/0061857 | A1 | 3/2011 | White | |

OTHER PUBLICATIONS

Written Opinion of the International Searching Authority issued in PCT/EP2013/065800 dated Jun. 23, 2014 (5 pages).
International Preliminary Report on Patentability from PCT/EP2013/065800 dated Dec. 11, 2014 (11 pages).
Norwegian Search Report issued in application No. 20120851 dated Feb. 26, 2013 (2 pages).
International Preliminary Report on Patentability from PCT/EP2013/065800 dated Nov. 18, 2014 (10 pages).

* cited by examiner

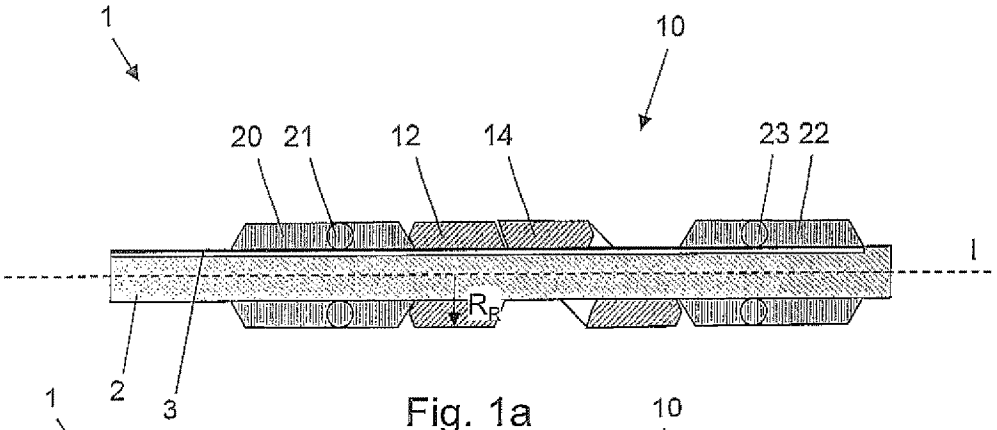
Fig. 1a
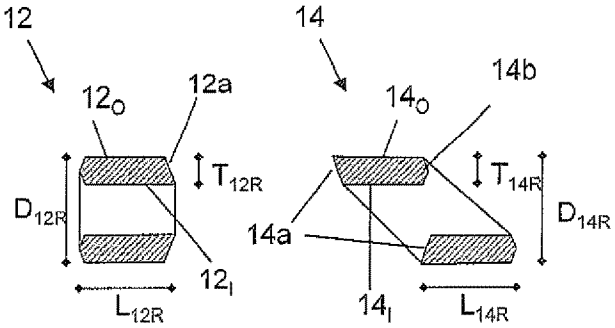
Fig. 1b
Fig. 1c
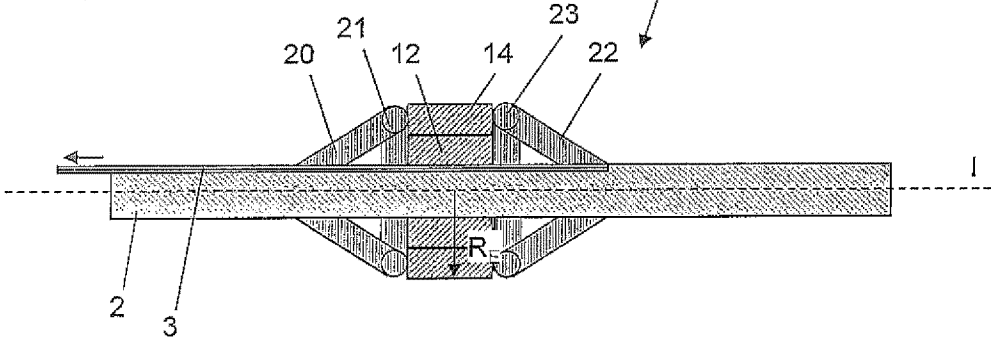
Fig. 2a
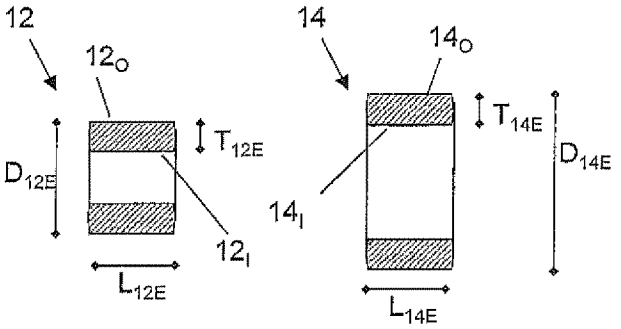
Fig. 2b
Fig. 2c

PLUGGING DEVICE

FIELD OF THE INVENTION

The present invention relates to a plugging device for sealing against an inner surface of a pipe.

BACKGROUND OF THE INVENTION

Several types of plugging devices are known for sealing against an inner surface of a pipe, such as a well bore of an oil and/or gas well. The plugging device is lowered into the well in a retracted state or run state, and, at a desired location, the plugging device is actuated to expand radially from the retracted state to an expanded state or set state. Plugging devices typically comprises a slips device for anchoring of the plugging device to the inner surface of the well bore and a sealing device for sealing against the inner surface of the well bore, i.e. to separate the oil and gas below the sealing device from the area above the sealing device.

Typically, design parameters for plugging devices are the relationship between the outer diameter in the retracted state and the outer diameter in the expanded state, the temperature and pressure in the well etc.

One example of a prior art plugging device is shown in U.S. Pat. No. 7,178,602. Here, the difference between the outer diameter of the sealing device in the expanded state and the retracted state is relatively low, i.e. it is not possible to expand the sealing device much. In certain oil and gas wells, there is a need for plugging devices which must pass a relatively narrow part of a well bore and then be able to expand radially to seal a wider part of the well bore further down in the well. The above-mentioned plugging devices may not be used in many such well due to the limited expansion.

Another example of a prior art plugging device is disclosed in US 2004/0069502. Here, seal elements (30a, 30b, 30c) are provided partially outside each other in the run state, and by axial compression, the seal elements are pressed further outwards and hence are radially expanded to seal the well. In the set state, the seal elements form a cone-shaped seal body. Each seal element comprises several expansion fingers. The expanding seal elements are supported by an anti-extrusion system (40) which again are supported by backup rings (50) and also a cylindrical cone (60) connected to, and axially displaceable in relation to, the inner mandrel. The cone (60) is also acting as a pivoting point for the backup ring (50). It should be noted that each of the seal elements are in contact with the mandrel or are connected to connection devices in contact with the mandrel both in the run state and in the set state.

In certain wells, there is a desire to insert a plugging device through an insert safety valve, a straddle packer or other types of packers having a through fluid bore. In other wells, the well bore itself may have collapsed, allowing only small diameter plugging devices to pass.

Hence, the object of the present invention is to provide a plugging device capable of passing through a relatively narrow well bore while in its retracted state and thereafter be set and seal off a relatively wider well bore in the expanded state. Another object is to be able to use a wider range of materials in the sealing device.

SUMMARY OF THE INVENTION

The present invention relates to a plugging device for sealing against an inner surface of a pipe, comprising:

a mandrel;

a sealing device comprising a first body provided circumferentially around the mandrel, an upper supporting device provided axially above the first body and a lower supporting device provided axially below the first body;

an actuating device connected to at least one of the supporting devices for actuating the sealing device between a retracted state and a expanded state;

characterized in that the sealing device further comprises a second, sealing body made of an elastic or ductile material and provided circumferentially around the mandrel, where:

the second, sealing body is provided axially adjacent to the first body in the retracted state;

an inner surface of the second, sealing body is engaged with an outer surface of the first body in the expanded state;

the second sealing body is moved from the retracted state to the expanded state by an axial displacement of at least one of the supporting devices towards each other.

In an aspect, the first body is a first sealing body made of an elastic or ductile material, and where an inner surface of the first sealing body is engaged with an outer surface of the mandrel. According to this embodiment, the second, sealing body is the second sealing body of the plugging device.

In an aspect, the first body is cylindrical in its retracted state and its expanded state.

In an aspect, the first body comprises an inclined sliding surface faced towards the adjacent second sealing body.

In an aspect, the second sealing body comprises an inclined sliding surface faced towards the adjacent first body.

In an aspect, the outer surface of the first body is aligned with the outer surface of the second sealing body in the retracted state.

In an aspect, the second sealing body has the shape of an inclined cylinder in the retracted state.

In an aspect, the second sealing body has the shape of an inclined, circular cylinder in the retracted state.

In an aspect, the second sealing body comprises an extrusion preventing supporting device.

In an aspect, the sealing device further comprises a third sealing body made of an elastic or ductile material and provided circumferentially around the mandrel, where:

the third sealing body is provided axially adjacent to the second sealing body in the retracted state;

an inner surface of the third sealing body is engaged with the outer surface of the second sealing body in the expanded state;

the third sealing body is moved from the retracted state to the expanded state by an axial displacement of at least one of the supporting devices towards each other.

In an aspect, the third sealing body has the shape of an inclined cylinder in the retracted state.

In an aspect, the third sealing body comprises an extrusion preventing supporting device.

In an aspect, the outer surface of the second sealing body is aligned with the outer surface of the third sealing body in the retracted state.

DETAILED DESCRIPTION

Figures 4A, 4B, 5A, 5B:
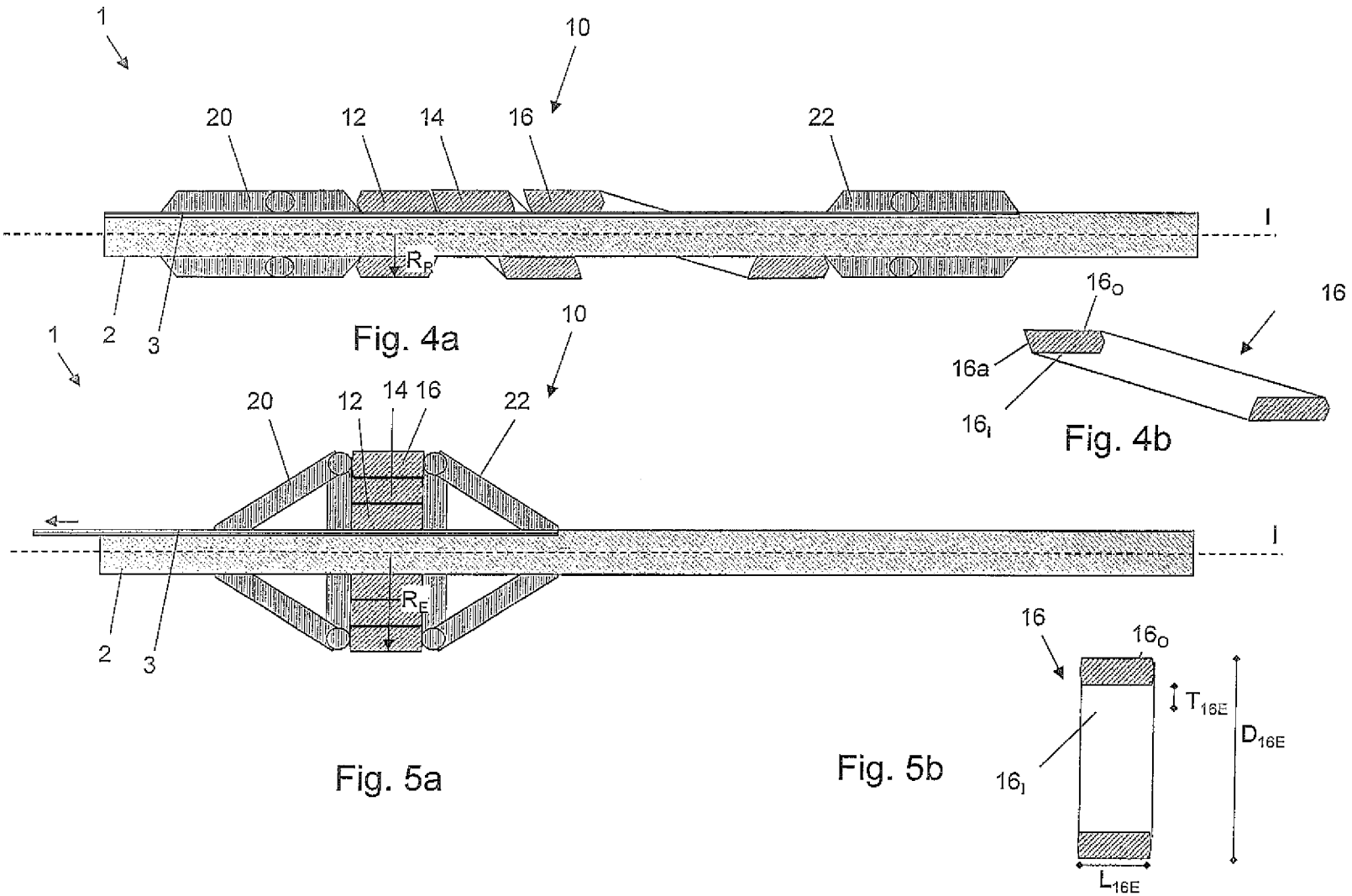
Figure 6C:
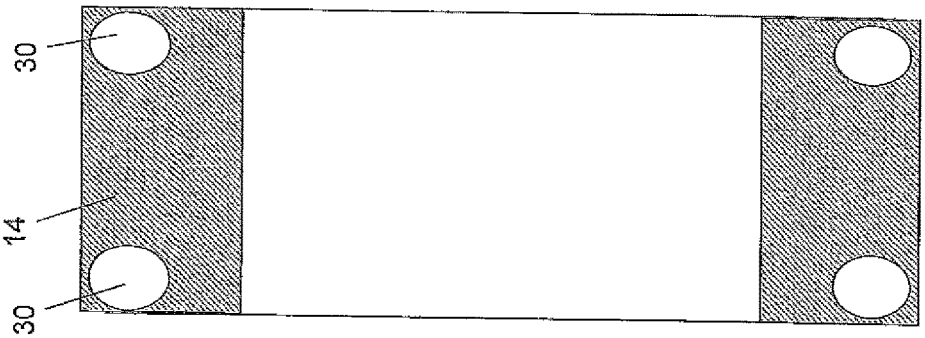
Figure 6B:
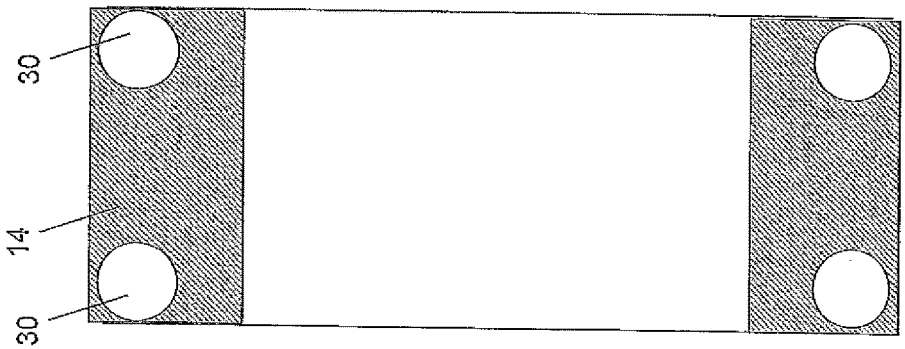
Figure 6A:
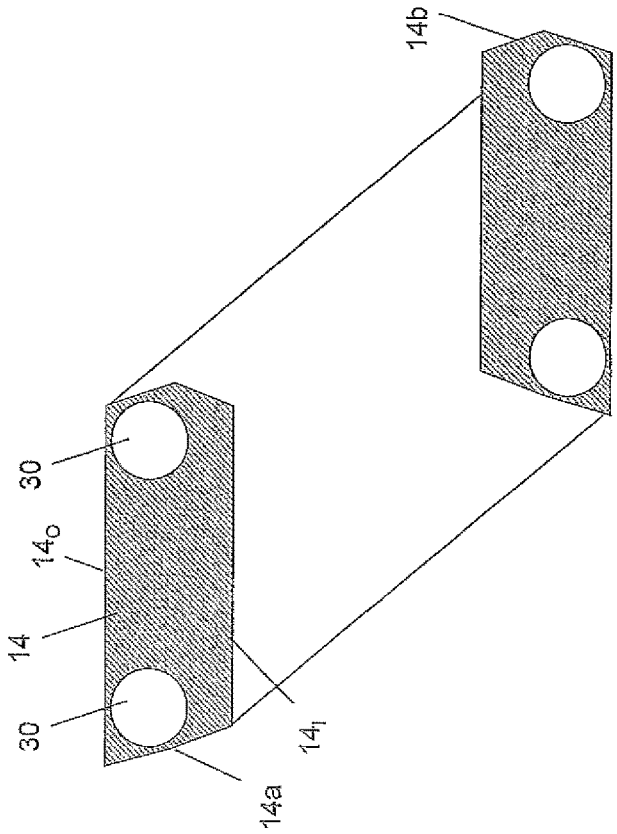

Embodiments of the invention will now be described in detail with reference to the enclosed drawings, where:

FIG. 1*a* illustrates a cross sectional view of a first embodiment of the sealing device in the retracted state;

FIG. 1*b* illustrates a cross sectional view of the first sealing body in the retracted state;

FIG. 1*c* illustrates a cross sectional view of the second sealing body in the retracted state;

FIG. 2*a* illustrates a cross sectional view of the first embodiment of the sealing device in the expanded state;

FIG. 2*b* illustrates a cross sectional view of the first sealing body in the expanded state;

FIG. 2*c* illustrates a cross sectional view of the second sealing body in the expanded state;

FIG. 3 illustrates a perspective view of the second sealing body in the retracted state;

FIG. 4*a* illustrates a second embodiment of the sealing device in the retracted state;

FIG. 4*b* illustrates a cross sectional view of the third sealing body in the retracted state;

FIG. 5*a* illustrates the second embodiment of the sealing device in the expanded state;

FIG. 5*b* illustrates a cross sectional view of the third sealing body in the expanded state;

FIGS. 6*a*, 6*b* and 6*c* illustrate an alternative embodiment of the second sealing body.

It is now referred to FIG. 1*a*, where a part of a plugging device 1 for sealing against an inner surface of a pipe is shown. Most of FIG. 1*a* illustrates a sealing device. The plugging device 1 comprises a mandrel 2, where the sealing device 10 is provided radially outside the mandrel 2. The mandrel 2 is here denoting a structural part of the plugging device to which other parts are connected. In plugging devices, the mandrel has a substantially cylindrical shape. Often, the mandrel 2 is the main carrying element of the plugging device.

In FIGS. 1*a* and 2*a*, the longitudinal center axis I of the plugging device 1 is indicated. The longitudinal axis I also forms a center axis of the mandrel 2.

The sealing device 10 is configured to be provided in a retracted state and an expanded state, where the radial radius $R_E$ of the sealing device in the expanded state is larger than the radial radius $R_R$ of the sealing device in the retracted state.

The radial radius $R_E$ is the radial distance from the center axis I to the outer surface of the sealing device in the expanded state. The radial radius $R_R$ is the radial distance from the center axis I to the outer surface of the sealing device in the run state.

In addition, the plugging device 1 typically comprises a slips device (not shown) for anchoring the plugging device 1 to the inside surface of the pipe before the sealing device is brought from its retracted state to its expanded state. The slips device may be based on the principle shown in U.S. Pat. No. 7,178,602, or another principle, and will not be described here in detail.

Moreover, the plugging device 1 typically comprises a connection interface (not shown) for connection to a setting tool. The setting tool is used to actuate the sealing device 10 (and the slips device) from the retracted state to the expanded state. In the drawings, the left side is the upper side of the plugging device 1, i.e. the connection interface is provided on the left side of the sealing device 10 in FIG. 1*a*. The right side is the lower side of the plugging device 1.

The design challenge for the present invention is that the plugging device must pass through a first well bore having an inner diameter of 2" (5.08 cm) in the retracted state and thereafter seal a second well bore having an inner diameter of 6.276" (15.94 cm) in the expanded state. Of course, the present invention is not limited to such use.

The sealing device 10 comprises a first sealing body 12 provided circumferentially around the mandrel 2, an upper supporting device 20 provided axially above the first sealing body 12 and a lower supporting device 22 provided axially below the first sealing body 12. The plugging device 1 further comprises an actuating device 3 connected to at least one of the supporting devices 20, 22 for actuating the sealing device 10 between a retracted state and an expanded state, typically via the abovementioned connection interface.

The upper supporting device 20, the lower supporting device 22 and the actuating device 3 are considered known for a skilled person, for example from U.S. Pat. No. 7,178,602, and will not we described herein in detail. When comparing FIG. 1*a* with FIG. 2*a*, it is apparent that the upper and lower supporting devices 20, 22 each comprises supporting legs or arms being pivotally connected to each other at 21, 23 respectively. In FIGS. 1*a* and 2*a*, it is shown that the actuating device 3 is an elongated member provided axially outside the mandrel 2, where the elongated member is provided from the upper end of the sealing device and down to the lowermost part of the lower supporting device 22, to which the elongated member is connected.

The sealing device 10 is in the retracted state in FIG. 1*a* when inserted into the pipe. At the desired location, the sealing device 10 is brought to its expanded state by pulling the actuating device 3 axially upwards in relation to the mandrel 2. It should be noted that the upper supporting device 20 is not pulled axially upwards together with the actuating device 3, the upper end of the upper supporting device 20 is connected to the mandrel 2 and is only pivoting as shown in FIG. 1*a* and FIG. 2*a*.

As mentioned above, this operation is typically performed by means of the setting tool via the connection interface. Consequently, the upper and lower supporting devices 20, 22 pivot about 21, 23 and support the first sealing body 12. In a preferred embodiment, the first sealing body 12 is also axially compressed, thereby causing a radial expansion of the first sealing body 12. It should be noted that the radial expansion of the first sealing body 12 may be directed both radially inwards in order to improve the fluid seal between the first sealing body 12 and the mandrel 2, and radially outwards.

In FIG. 1*b* and FIG. 2*b* it is shown that an inner surface $\mathbf{12}_I$ of the first sealing body 12 is engaged with an outer surface of the mandrel 2, both in the retracted state (FIG. 1*a*) and in the expanded state (FIG. 2*a*). Hence, the inner surface $\mathbf{12}_I$ is parallel with the longitudinal axis I of the plugging device 1 in both the expanded state and the retracted state. Also the outer surface $\mathbf{12}_O$ is parallel with the longitudinal axis I of the plugging device 1 in both the set state and the run state. In this embodiment, the first sealing body 12 forms the innermost sealing body in the expanded state. In FIGS. 1*a* and 1*b* it is shown that the sealing device 10 further comprises a second sealing body 14 provided circumferentially around the mandrel 2. The second sealing body 14 is provided axially adjacent to the first sealing body 12 in the retracted state. In FIG. 1*a* it is shown that the second sealing body 14 is provided on the lower side (i.e. to the right side) of the first sealing body 12. An inner surface $\mathbf{14}_I$ (FIG. 1*b*, 1*c*, 2*b*, 2*c*) of the second sealing body 14 is also engaged with the outer surface of the mandrel 2 in the retracted state. The inner surface $\mathbf{14}_I$ of the second sealing body 14 is engaged with outer surface $\mathbf{12}_O$ of the first sealing body 12 in the expanded state. Hence, as shown in FIG. 2*a*, the second sealing body 14 is provided circumferentially around the first sealing body 12 in the expanded state.

Also the inner surface $14_I$ is parallel with the longitudinal axis I of the plugging device 1 in both the set state and the run state and the outer surface $14_O$ is parallel with the longitudinal axis I of the plugging device 1 in both the set state and the run state. In this embodiment, the second sealing body 14 forms the outermost sealing body in the expanded state.

It should be noted that the second sealing body 14 is disengaged from the mandrel 2 in the expanded state, as illustrated in FIG. 2*a*. Here, the inner surface $14_I$ is only in contact with the mandrel 2 via the first sealing body 12, there is no connection device engaging the second sealing body 14 with the mandrel 2. Hence, it is possible to provide the entire second sealing body 14 radially outside the first sealing body 12. The second sealing body 14 is moved from the retracted state to the expanded state by an axial displacement of at least one of the supporting devices 20, 22 towards each other. As described above, in FIGS. 1*a* and 2*a*, the lower supporting device 22 is axially displaced upwards towards the upper supporting device 20. However, it is also possible to axially displace the upper supporting device 20 downwardly towards the lower supporting device 22, alternatively to displace both of them towards each other.

In order to simplify the movement of the second sealing body 14 from the retracted state to the expanded state, the first sealing body 12 may comprise an inclined sliding surface 12*a* faced towards the adjacent second sealing body 14. The inclined sliding surface 12*a* will help the second sealing body 14 to slide up and outside of the first sealing body 12 during the movement from the retracted state to the expanded state. Moreover, the second sealing body 14 may also comprise an inclined sliding surface 14*a* faced towards the adjacent first sealing body 12 in order to further help the second sealing body 14 to slide up and outside of the first sealing body 12 during the movement from the retracted state to the expanded state.

As shown in FIGS. 1*b* and 2*b*, the first sealing body 12 is cylindrical in its retracted state and in its expanded state. The outer radial diameter D12R in the retracted state may be equal to the outer diameter D12E in the expanded state, alternatively the outer radial diameter D12E in the expanded state may be slightly larger than the outer radial diameter D12R in the retracted state due to an increase of the thickness T12E in the expanded state due to the axial compression of the first sealing body 12 by means of the upper and lower supporting devices 20, 22. It should however be noted that the main contribution to the increased diameter of the sealing device in the expanded state is provided by assembling the second sealing body 14 radially outside the first sealing body 12.

As shown in FIGS. 1*c* and 2*c*, the second sealing body 14 has the shape of an inclined cylinder, or has the shape of an inclined, circular cylinder, in the retracted state (FIG. 1*c*). A perspective view of the shape of the second sealing body 14 is shown in FIG. 3. In the expanded state, the second sealing body 14 is cylindrical (FIG. 2*c*). Preferably, the outer surface $12_O$ of the first sealing body 12 is aligned with the outer surface $14_O$ of the second sealing body 12 in the retracted state, i.e. the outer radial diameter D12R of the first sealing body 12 in the retracted state is equal to the outer radial diameter D14R of the second sealing body 14 in the retracted state. In the expanded state, the outer radial diameter D14E of the second sealing body 14 is substantially equal to the outer radial diameter D12E of the first sealing body 12 plus 2 times the radial thickness T14E of the second sealing body 14 in the expanded state. As shown in FIG. 2*a*, also the second sealing body 14 may be axially compressed and thereby expand radially due to the upper and lower supporting devices 20, 22.

In the expand state shown in FIG. 2*a*, the first sealing body 12 seals against the outer surface of the mandrel 2, the outer surface $12_O$ of the first sealing body 12 seals against the inner surface $14_I$ of the second sealing body 14 and the outer surface $14_O$ seals against the inner surface of the pipe. In the embodiment shown in FIGS. 1*a* and 2*a*, the outer radial radius $R_E$ in the expanded state is approximately 1.5 times the outer radial radius $R_R$ in the retracted state.

The first and second sealing bodies 12, 14 are made of an elastic or ductile material, such as rubber, elastomers or any other suitable material for suck sealing bodies. It should be noted that by providing the second sealing body 14 as described above as an inclined cylinder in the retracted state and thereafter as a cylinder outside the first sealing body 12 in the expanded state, there is a considerable reduction in the tension of the sealing bodies in the expanded state when compared with prior art sealing bodies. According to this, the material of the second sealing body will be twisted, not stretched and compressed. Hence, materials (typically rubber materials) which are suitable due to their mechanical properties, their temperature resistive properties and their chemical properties, but which have poor properties regarding elongation before break, tear resistance etc, may still be used in this plugging device. Hence, for example FKM (fluorelastomers) and FFKM (perfluoroelastomers) may be used as materials in the sealing body, materials which may withstand high temperatures and/or high concentrations of H2S, CO, HCl, brine inhibiters, etc.

In order to prevent extrusion of the material in the second sealing body 14 in the expanded state, the second sealing body 14 may comprise one or several extrusion preventing supporting devices 30 (FIGS. 6*a*, 6*b* and 6*c*) incorporated in the sealing body. Such extrusion preventing supporting devices are considered to be known and will not be described here in detail. One type of extrusion preventing supporting devices is for example described in US 2006/0290066. It should be noted that also the first sealing body 12 may comprise such a supporting device. However, as the first sealing body 12 is supported between the upper and lower supporting devices 20, 22, this would normally not be necessary.

It is now referred to FIG. 4*a*, 4*b* and FIGS. 5*a* and 5*b*. Here, in addition to the first sealing body 12 and the second sealing body 14 described above, the sealing device 10 comprises a third sealing body 16 provided circumferentially around the mandrel 2. The third sealing body 16 is provided axially adjacent to the second sealing body 14 in the retracted state. The third sealing body 16 is made of an elastic or ductile material.

As shown in FIG. 4*a*, the third sealing body 16 is provided on the lower side of the second sealing body 14. An inner surface $16_I$ of the third sealing body 16 is also engaged with the outer surface of the mandrel 2 in the retracted state. An inner surface $16_I$ of the third sealing body 16 is engaged with the outer surface $14_O$ of the second sealing body 14 in the expanded state. Hence, as shown in FIG. 5*a*, the third sealing body 16 is provided circumferentially around the second sealing body 14 in the expanded state. The third sealing body 16 is moved from the retracted state to the expanded state by an axial displacement of at least one of the supporting devices 20, 22 towards each other.

Also the inner surface $16_I$ is parallel with the longitudinal axis I of the plugging device 1 in both the set state and the run state and the outer surface $16_O$ is parallel with the longitudinal axis I of the plugging device 1 in both the set state and the run state. In this embodiment, the third sealing body 16 forms the outermost sealing body in the expanded state.

It should be noted that the third sealing body 16 is disengaged from the mandrel 2 in the expanded state, as illustrated in FIG. 5*a*. Here, the inner surface $\mathbf{16}_I$ is only in contact with the mandrel 2 via the first and second sealing bodies 12, 14, there is no connection device engaging the third sealing body 16 with the mandrel 2. Hence, it is possible to provide the entire third sealing body 16 radially outside the second sealing body 14.

The third sealing body 16 has the shape of an inclined, circular cylinder in the retracted state. Moreover, as described above, the second sealing body 14 may comprise an inclined sliding surface 14*b* faced towards the adjacent third sealing body 16. The inclined sliding surface 14*b* will help the third sealing body 16 to slide up and outside of the second sealing body 14 during the movement from the retracted state to the expanded state. Moreover, the third sealing body 16 may also comprise an inclined sliding surface 16*a* faced towards the adjacent second sealing body 14 in order to further help the third sealing body 16 to slide up and outside of the second sealing body 14 during the movement from the retracted state to the expanded state.

In the expanded state, the third sealing body 16 is the outermost sealing body, i.e. it is the third sealing body 16 which seals against the inner surface of the pipe. Hence, the third sealing body 16 may comprise one or several extrusion preventing supporting devices. In the embodiment shown in FIGS. 4*a* and 5, the outer radial radius $R_E$ in the expanded state is approximately 2.25 times the outer radial radius $R_R$ in the retracted state. Depending on the design of the plugging device, i.e. the relationship between the outer diameter of the mandrel and the thickness of the sealing bodies, it is possible to provide a plugging device where the outer radial radius $R_E$ in the expanded state is preferably from 1.5 to 3.5 times the outer radial radius $R_R$ in the retracted state, however also larger expansions would be possible. However, by adding further sealing bodies still higher expansions would be possible.

In the above embodiments, the outer surface $\mathbf{12}_O$ of the first sealing body 12 is aligned with the outer surface $\mathbf{14}_O$ of the second sealing body 12, i.e. their outer radial diameter in the retracted state are equal to each other. Moreover, also the outer surface $\mathbf{16}_O$ of the third sealing body 16 is aligned with the first and second sealing bodies 12, 14.

In the above embodiments, it is shown that the arms of the upper and lower supporting devices 20, 22 being closest to the sealing bodies are pivoted from a position substantially parallel to the longitudinal axis I in the retracted state to position substantially perpendicular to the longitudinal axis I in the expanded position. In these embodiments, the lengths L12E, L14E, L16E of each sealing body 12, 14, 16 in the expanded state are substantially equal to each other. However, in an alternative embodiment, the arms of the upper and lower supporting devices 20, 22 being closest to the sealing bodies may be pivoted to a position in which they have an angle of 30-60°. In such a case, the lengths L12E, L14E, L16E of each sealing body 12, 14, 16 in the expanded state, and possibly also their cross sectional shape, would be adapted to the available space between the upper and lower supporting devices.

In the above embodiments, the outermost sealing body in the expanded state protrudes radially with respect to the first and second supporting devices 20, 22. The sealing device 10 is preferably designed to avoid that the first and second supporting devices 20, 22 are in contact with the inner surface of the pipe, i.e. they have a outer radial diameter in the expanded state that is less than the inner diameter of the pipe. The extrusion preventing supporting devices 30 is then preventing the material of the outermost sealing body to extrude into the space between the first and second supporting devices 20, 22 and the inner surface of the pipe.

In an alternative embodiment, the first sealing body may be made of another material than a sealing material, i.e. the abovementioned elastic or ductile material. Here, the hereinafter so-called first body may be a body engaged with, fixed to (welded to, glued to or even integral with) the mandrel 2, in a way preventing any fluid to pass between the first body and the mandrel 2. The first body may be made of the same material as the mandrel, or another suitable material, such as metal. Hence, the first body is identical in the retracted and expanded state. The second sealing body will here be the only sealing body providing the necessary sealing between the outer surface of the first body and the inner surface of the second sealing body and between the outer surface of the second sealing body and the inner surface of the well.

This embodiment may look identical to the embodiment shown in FIGS. 1*a* and 1*b*, the only difference is that the material of the first body 12 would be different.

It would also be possible to use such a first body 12 with more than one sealing body, for example two sealing bodies 14, 16 as shown in FIG. 5*a*.

The invention claimed is:

1. Plugging device for sealing against an inner surface of a pipe, comprising:

a mandrel;

a sealing device comprising a first sealing body made of an elastic or ductile material and provided circumferentially around the mandrel, an upper supporting device provided axially above the first body and a lower supporting device provided axially below the first body, and where the sealing device further comprises a second, sealing body made of an elastic or ductile material and provided circumferentially around the mandrel; and an actuating device connected to at least one of the supporting devices for actuating the sealing device between a retracted state and an expanded state, where the second, sealing body is provided axially adjacent to the first body in the retracted state, where the second, sealing body is moved from the retracted state to the expanded state by an axial displacement of at least one of the supporting devices towards each other, and where the second sealing body is assembled radially outside the first body in the expanded state; and where the inner surface of the second sealing body is parallel with the longitudinal axis of the plugging device in both the expanded state and the retracted state.

2. The plugging device according to claim 1, where the first body is cylindrical in the retracted state and the expanded state.

3. The plugging device according to claim 1, where the first body comprises an inclined sliding surface faced towards the adjacent second sealing body.

4. The plugging device according to claim 1, where the second sealing body comprises an inclined sliding surface faced towards the adjacent first body.

5. The plugging device according to claim 1, where an outer surface of the first body is aligned with an outer surface of the second sealing body in the retracted state.

6. The plugging device according to claim 1, where the second sealing body has the shape of an inclined cylinder in the retracted state.

7. The plugging device according to claim 6, where the second sealing body has the shape of an inclined, circular cylinder in the retracted state.

8. The plugging device according to claim 1, where the second sealing body comprises an extrusion preventing supporting device.

9. The plugging device according to claim 1, where the sealing device further comprises a third sealing body made of an elastic or ductile material and provided circumferentially around the mandrel, where:

the third sealing body is provided axially adjacent to the second sealing body in the retracted state;

an inner surface of the third sealing body is engaged with an outer surface of the second sealing body in the expanded state; and the third sealing body is moved from the retracted state to the expanded state by an axial displacement of at least one of the supporting devices towards each other.

10. The plugging device according claim 9, where the third sealing body (16) has the shape of an inclined cylinder in the retracted state.

11. The plugging device according to claim 9, where the third sealing body (16) comprises an extrusion preventing supporting device.

12. The plugging device according to claim 9, where an outer surface of the second sealing body is aligned with an outer surface of the third sealing body in the retracted state.

13. The plugging device according to claim 9, where the third sealing body is disengaged from the mandrel in the expanded state.

14. The plugging device according to claim 1, where the second sealing body is disengaged from the mandrel in the expanded state.

15. The plugging device according to claim 1, above claims, where the inner surface of the second sealing body is engaged with an outer surface of the mandrel in the retracted state and is engaged with an outer surface of the first body in the expanded state.

16. The plugging device according to claim 1, where the second sealing body is disengaged from the mandrel in the expanded state.

17. The plugging device according to claim 1, where the second sealing body is one, single sealing body in both the retracted and expanded states.

* * * * *